United States Patent [19]

Pearson

[11] Patent Number: 5,007,216

[45] Date of Patent: Apr. 16, 1991

[54] VENTILATION BAFFLE AND INSULATION STOP

[76] Inventor: David H. Pearson, 1350-13 Ave. SE., Salmon Arm B.C., Canada, V1E 2G7

[21] Appl. No.: 381,471

[22] Filed: Jul. 18, 1989

[51] Int. Cl.[5] ..... E04B 1/74; F24F 7/00

[52] U.S. Cl. ..... 52/94; 52/317; 98/32

[58] Field of Search ..... 52/317, 90, 94; 98/32, 98/37, 42

[56] References Cited

U.S. PATENT DOCUMENTS 322,491 12/1885 Clay ..... 52/317

4,069,628 1/1978 Kreimer ..... 52/317

*Primary Examiner*—James L. Ridgill, Jr.

*Attorney, Agent, or Firm*—Dellett, Smith-Hill and Bedell

[57] ABSTRACT

A baffle for use in an attic defined by a vertical exterior wall having a top wall plate, parallel ceiling joists supported by the top wall plate, and spaced apart, inclined rafters securely connected to the top wall plate and the ceiling joists is disclosed. The rafters typically have a roof deck fastened to their top surface. The baffle is installable between adjacent roof rafters to substantially block the flow of ventilating air through an opening located between the top surface of the wall plate and the underside of the roof deck. Once installed, the baffle of the present invention restricts flow of ventilating air between an exterior soffit and insulating material installed between the ceiling joists in the attic cavity. The baffle includes a rectangular panel, a bottom flap hingedly connected to the rectangular panel and attachable to the wall plate, side flaps hingedly connected on opposed ends of the rectangular panel and attachable to the inner face of the roof rafters, and a top flap hingedly connected to the rectangular panel and attachable to the underside of the roof deck. Preferably, the baffle consists of a unitary cardboard sheet having crease lines defining the joints between the rectangular panel and the bottom flap, top flap and side flaps respectively. The baffle may further include adjustment lines printed on one of its surfaces for adapting the baffle for installation in houses having variable spacing between adjacent roof rafters. Advantageously, the baffle can be used in combination with a companion baffle installable between adjacent roof rafters. The companion baffle enables flow of ventilating air between the exterior soffit and the attic cavity while substantially obstructing flow of ventilating air through the insulating material located between the attic ceiling joists.

5 Claims, 5 Drawing Sheets

VENTILATION BAFFLE AND INSULATION STOP

FIELD OF THE INVENTION

The present invention relates to construction materials, and more particularly to ventilation baffles and insulation stops which are installed between adjacent roof rafters of a house for regulating the flow of ventilating air into and out of the house attic, and for isolating and containing the insulating materials.

BACKGROUND OF THE INVENTION

It is commonplace in the construction of residential houses to install batt or particulate insulation between the ceiling joists of the house attic. However, problems may arise if the insulation is installed around the perimeter of the attic between the ceiling joists and the overlying roof deck to such an extent that air vents are blocked. Building codes in most jurisdictions presently require a free flow of ventilating air above the insulating material in order to cool the attic space during the summer months and restrict moisture buildup in the winter.

Soffit or eave vents are currently the most common type of residential attic ventilation. Such vents are intended to provide free flow of air through the opening between the top wall plate of the house and the underside of the roof deck. Ventilating air can circulate into and out of the attic cavity provided that this passageway remains unobstructed.

The need to have a ventilating passageway above the insulating material presents several problems. Excessive heat loss may result if ventilating air is permitted to flow freely through the attic. The thermal value of insulating material decreases dramatically if there is not dead air space above the insulating material to provide resistance to the conductive flow of heat.

Another problem which has arisen is the tendency of particulate insulating material to fall through the opening between the top wall plate of the house and the roof deck into the soffit space. Common practice today is to install cardboard or polystyrene vents in this opening and then stuff fibreglass insulation between the rafters and the vents above the top plate in order to act as a physical barrier. Particulate insulation is then blown into the attic cavity between the ceiling joists.

Although such fibreglass barriers prevent insulation from falling into the soffit space, they do not effectively restrict airflow. Consequently, the entire perimeter of the house between the top wall plate and the roof deck has very little insulating quality and no measurable R values. This allows for significant heat loss and may result in condensation problems in the attic.

The present invention is directed to a cardboard baffle which can be installed between adjacent roof rafters to regulate the flow of ventilating air into and out of the attic. One aspect of the invention is an insulation stop which can be installed between the top wall plate and the roof deck to act as a rigid air barrier and to prevent particulate insulation from inadvertently falling into the soffit. A second aspect of the invention is a ventilation baffle which can be installed between adjacent roof rafters to ensure that a ventilating passageway is maintained above the insulating material. Both configurations of the baffle preserve a dead air space above the insulating material by restricting airflow through the lower portion of the attic cavity adjacent the ceiling joists.

The insulation stop and ventilation baffle of the present invention are companion products which may be readily installed in combination to result in optimal attic ventilation, while at the same time maximizing the thermal value of the attic insulation.

Several insulation vents and baffles are disclosed in the prior art. U.S. Pat. No. 4,069,628 granted to Kreimer on Jan. 24, 1978 discloses an eave thermal baffle which can be installed between adjacent roof framing members. The baffle is constructed from a blank having a series of score lines or creases which define separate panels and flaps. The baffle blank can be bent about the score lines and installed to provide a trough for the passage of air from the eave-soffit area into the attic.

U.S. Pat. No. 4,189,878 granted to Fitzgerald on Feb. 26, 1980 also discloses a house roof insulation vent which is attachable between adjacent roof rafters. The vent consists of a generally rectangular sheet made of corrugated cardboard or the like. Each sheet has a series of crease lines which enable the sheet to be folded into hingedly connected sections and installed between the roof rafters of the house. Once installed, the invention creates a passageway for free flow of ventilating air from the eave or soffit area along the interior base of the roof boards into the attic cavity. Other combined insulation stops and ventilation baffles are disclosed in U.S. Pat. No. 3,863,553 issued Feb. 4, 1975 to Koontz and U.S. Pat. No. 3,160,987 issued Dec. 15, 1964 to Pinkley.

The above-noted prior art references have several apparent shortcomings. The principal drawback of the Kreimer baffle is that it is designed to fit between roof rafters having a standard spacing and a single truss heel size. Accordingly, it cannot be readily adapted to suit alternative framing sizes. The Fitzgerald baffle also has crease lines and flaps which are fixed at a standard size and therefore it is similarly unsuitable for adaptation to non-standard construction dimensions.

The present invention, by contrast, incorporates a series of strategically placed perforated crease lines and preprinted cut and score lines to allow adjustment of the width and height of the baffle to suit the dimensions of the particular job. For example, the present invention can be readily adapted for installation in houses having 12 inch, 16 inch or 24 inch rafter spacing, as well as a number of truss heel sizes.

Furthermore, unlike the Kreimer and Fitzgerald references, one aspect of the present invention also includes a further element which completely blocks the flow of air between the top wall plate of the house and the roof deck. This configuration completely avoids the possibility that particulate insulation could inadvertently fall through the openings located around the periphery of the attic into the soffit space. Used in conjunction with the ventilation baffle, it improves the isolation and containment of the insulation material. U.S. Pat. No. 3,240,144 issued Mar. 15, 1966 to Lind discloses a baffle consisting of a rectangular plate forming a dam to contain the insulation, but this baffle is designed to allow air to flow over the top of the baffle.

SUMMARY OF THE INVENTION

In accordance with the invention there is provided a baffle for use in an attic defined by a vertical exterior wall having a top wall plate, parallel ceiling joists supported by the top wall plate, and spaced apart, inclined rafters securely connected to the top wall plate and the ceiling joists. The rafters typically have a roof deck fastened to their top surface. The baffle is installable between adjacent roof rafters to substantially block the flow of ventilating air through an opening located between the top surface of the wall plate and the underside of the roof deck. Once installed, the baffle of the present invention restricts flow of ventilating air between an exterior soffit and insulating material installed between the ceiling joists in the attic cavity.

The baffle includes a rectangular panel, a bottom flap hingedly connected to the rectangular panel and attachable to the wall plate, side flaps hingedly connected on opposed ends of the rectangular panel and attachable to the inner face of the roof rafters, and a top flap hingedly connected to the rectangular panel and attachable to the underside of the roof deck.

Preferably, the baffle consists of a unitary cardboard sheet having crease lines defining the joints between the rectangular panel and the bottom flap, top flap and side flaps respectively.

The baffle may further include adjustment lines printed on one of its surfaces for adapting the baffle for installation in houses having variable spacing between adjacent roof rafters.

Advantageously, the baffle can be used in combination with a companion baffle installable between adjacent roof rafters. The companion baffle enables flow of ventilating air between the exterior soffit and the attic cavity while substantially obstructing flow of ventilating air through the insulating material located between the attic ceiling joists.

BRIEF DESCRIPTION OF THE DRAWINGS

In drawings which illustrate embodiments of the invention.

DETAILED DESCRIPTION OF THE PREFERRED EMBODIMENT

Figure 1:
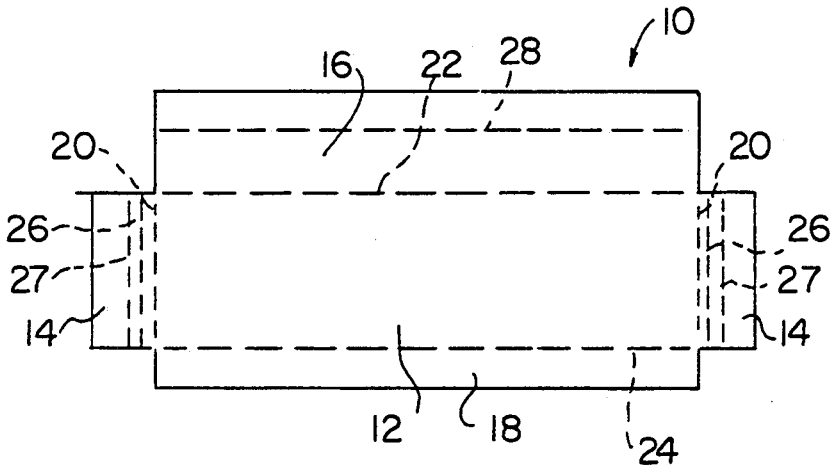
FIG. 1 is a top, plan view of one configuration of the baffle in its flat condition prior to installation.

The present invention is directed to a foldable cardboard baffle which is installable between adjacent roof rafters of a house. The baffle acts as a rigid barrier separating ventilating air and the attic insulation.

Two configurations of the invention are illustrated in the drawings and described below. The first configuration shown in FIGS. 1–3 acts as a complete barrier to the flow of air through the opening located between the top wall plate of the house and the underside of the roofing boards. The second configuration shown in FIGS. 4–6 permits air flow through the opening into the attic, while at the same time restricting air flow through the insulation. The two configurations can be installed in combination in a typical residential house in order to provide optimal attic ventilation and to preserve a protected dead air space above the insulation.

With reference to FIG. 1, baffle 10 is shown in plan view in its flat condition prior to installation. Baffle 10 is preferably composed of moisture-resistant, corrugated cardboard which is readily bendable. Each baffle 10 includes a generally rectangular panel 12 having side flaps 14 hingedly connected at opposed ends of panel 12 along its side edges. The joints between side flaps 14 and panel 12 are defined by perforated crease lines 20.

Baffle 10 also has a top flap 16 hingedly connected along the top edge of panel 12 and a bottom flap 18 hingedly connected along the bottom edge of panel 12. The joints between flaps 16, 18 and panel 12 are defined by crease lines 22 and 24 respectively.

Each side flap 14 also has crease lines 26, 27 which extend lengthwise parallel to crease lines 20. As discussed further below, crease lines 26, 27 allow baffle 10 to be adjusted for installation in houses having nonstandard framing dimensions.

Top flap 16 also has an additional crease line 28 extending between its side edges parallel to crease line 24. This permits adjustment of baffle 10 to fit different rafter heel sizes as discussed below.

Figure 2:
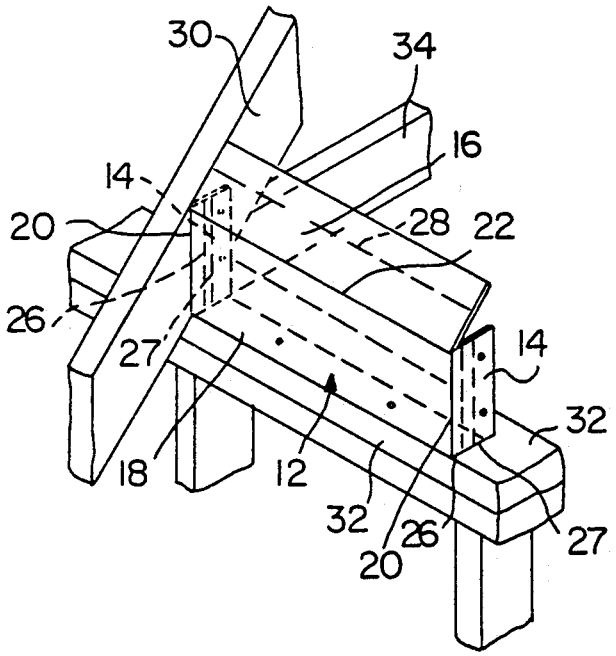
FIG. 2 is a perspective view of the baffle of FIG. 1 installed between adjacent roof rafters.

Baffle 10 is installed between adjacent roof rafters 30 as shown in FIG. 2. Rafters 30 typically extend parallel to one another from the top plate 32 of the house wall to the apex of the roof. A roof deck 33 is usually nailed on top of roof rafters 30 and a suitable covering, such as shakes or shingles, is fastened on top of roof deck 33.

The attic ceiling joists 34 are also connected to rafters 30 and top plate 32 as shown in FIG. 2. Insulating material is typically installed between and above attic ceiling joists 34 in order to reduce heat loss from the house.

Figure 3:
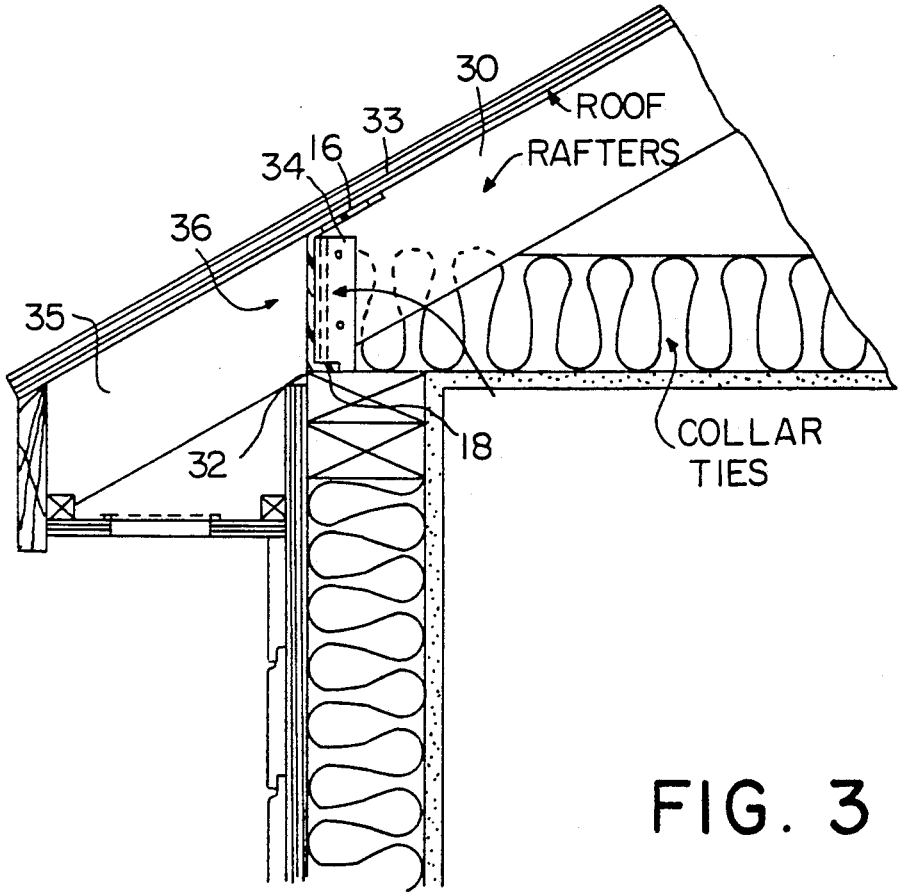
FIG. 3 is a sectional view of a portion of a house attic and soffit space with the baffle of FIG. 1 installed.

An opening 36 is defined between the top plate 32 of the house wall and the overlying rafters 30 and roof deck 33. As shown in FIG. 3, opening 36 permits the flow of ventilating air between the soffit or eave area of the house 35 and the interior of the attic. One problem which has arisen, particularly when particulate insulating material is blown into the attic between adjacent ceiling joists 34, is a tendency of such insulating material to fall through opening 36 into soffit 35. Once installed, baffle 10 avoids this problem by acting as a positive barrier completely blocking opening 36. By blocking air flow through opening 36 baffle 10 also preserves a dead air space above the attic insulation.

In use, baffle 10 is installed by folding bottom flap 18 downwardly to a position normal to panel 12. Opposed side flaps 14 are folded inwardly to a position normal to panel 12 and fastened with tacks to the inner surface of adjacent rafters 30. Top flap 16 is folded downwardly along either crease lines 22 or 28 to conform to the angle of the roof line and may be securely fastened to the underside of roof deck 33. Optionally, bottom flap 18 may be fastened to the top wall plate of the house in a similar manner.

In most residential houses rafters 30 are typically placed a standard distance apart. However, small variations in framing dimensions are not uncommon. Baffle 10 allows for variations in the distance between adjacent rafters 30 by providing extra, perforated crease lines 26, 27 in side flaps 14. For example, side flaps 14 can be folded inwardly along crease line 26 rather than along crease line 20; this effectively extends the longitudinal dimensions of panel 12 by approximately one inch. Thus baffle 10 can be readily installed to fully block opening 36 even if the distance between adjacent rafters 30 is slightly greater than normal.

Once baffle 10 is installed as described as above, opening 36 is completely blocked by panel 12. Insulating material can then be freely installed around the perimeter of the attic against the inner-facing surface of baffle 10 without risk that insulating material will inadvertently fall into soffit 35. Baffle 10 also protects the attic insulation and maximizes its thermal effectiveness by blocking air flow through opening 36 as discussed above.

Building codes in most jurisdictions presently require uniformly distributed, unobstructed vent areas to permit free flow of ventilating air into and out of the attic. Accordingly, it is improper to block all of the openings 36 around the perimeter of the attic by installing baffles 10. Rather, baffles 10 are perferably used in combination with venting baffles 40. As a general rule of thumb, one venting baffle 40 should be installed per 100 square feet of attic area, assuming a rafter spacing of 24 inches. The remaining openings 36 between adjacent rafters 30 can be completely blocked by baffle 10 as discussed above.

Figure 4:
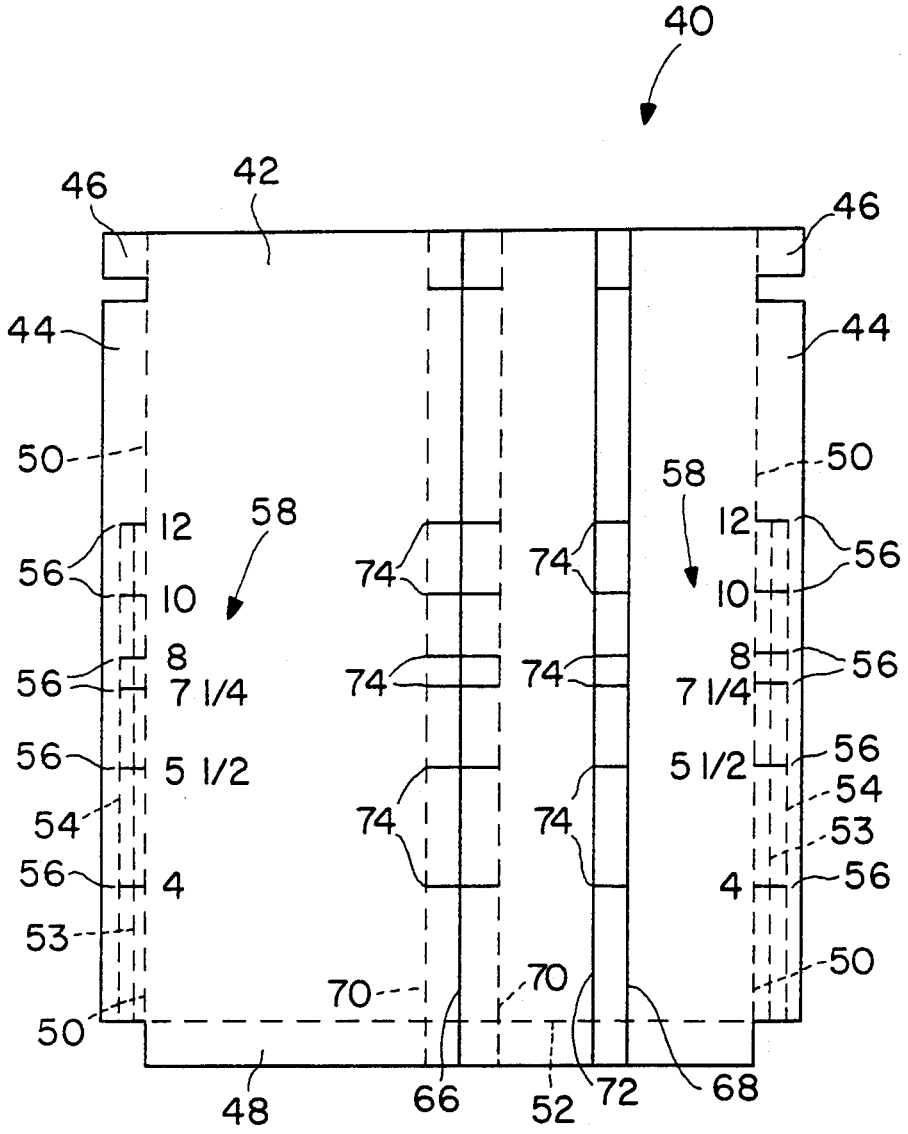
FIG. 4 is a top, plan view of a second configuration of the baffle in its flat condition prior to installation.
Figure 5:
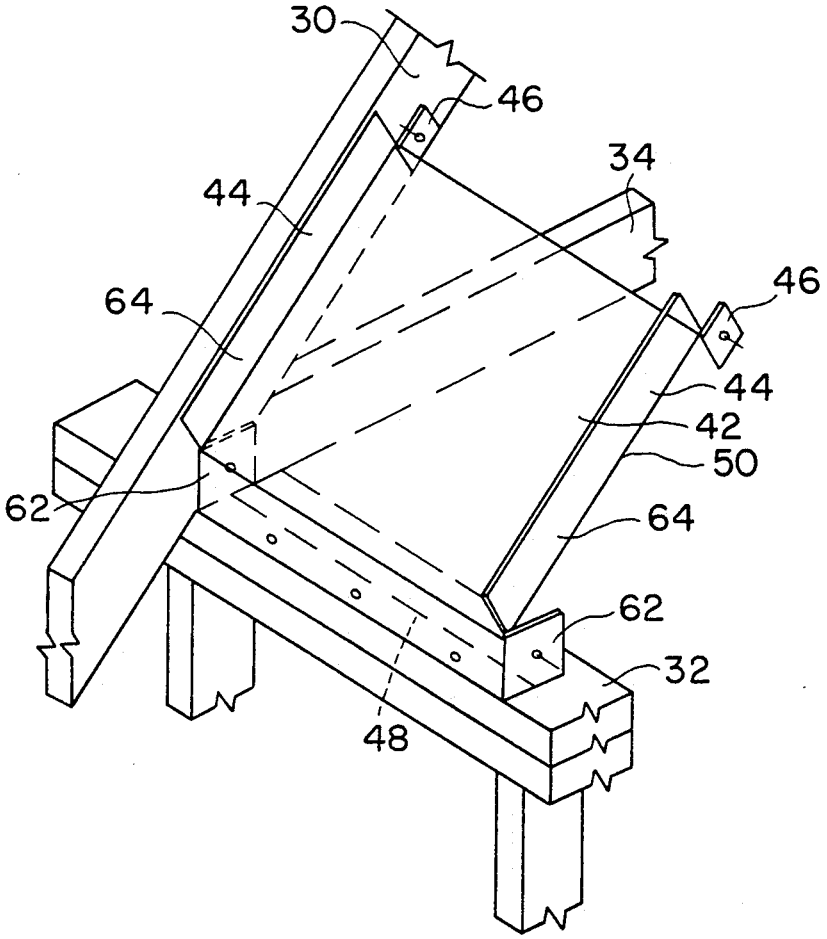
FIG. 5 is a perspective view of the baffle of FIG. 4 installed between adjacent roof rafters.
Figure 6:
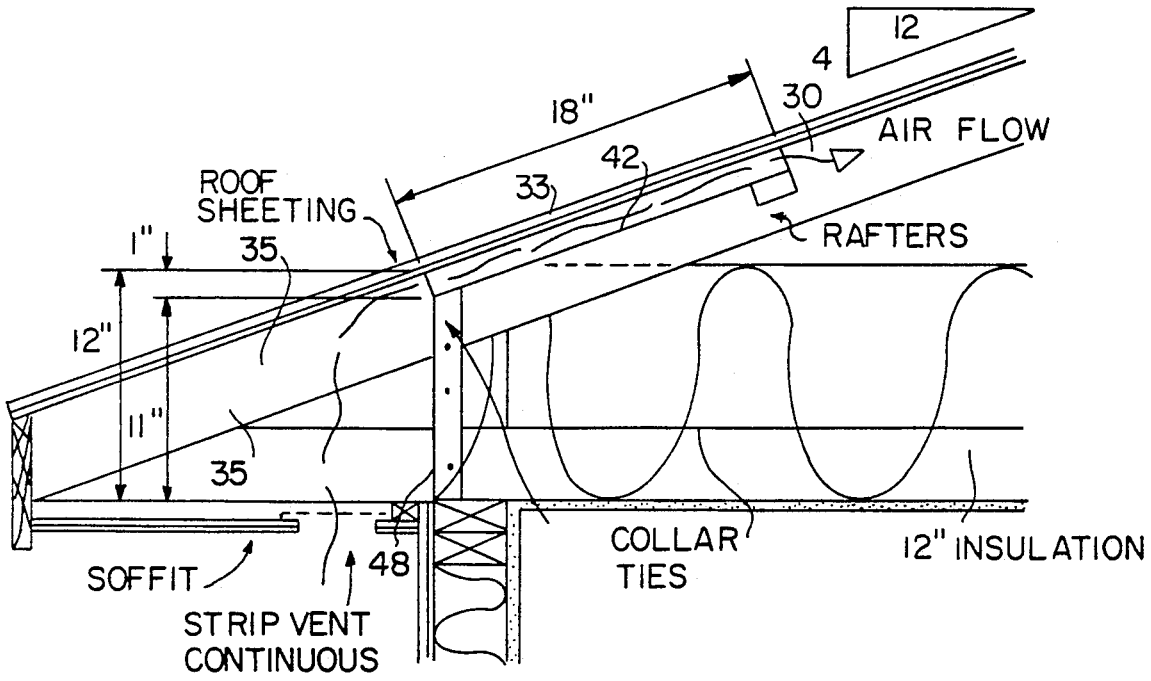
FIG. 6 is a sectional view of a portion of a house attic and soffit space with the baffle of FIG. 4 installed.

Venting baffles 40 are depicted in FIGS. 4–6. The purpose of venting baffles 40 is to provide an unobstructed passageway for the flow of air from soffit 35 through opening 36 and along the interior surface of roof deck 33 into the attic cavity.

Venting baffle 40 is shown in its flat condition prior to installation in FIG. 4. Like baffle 10, venting baffle 40 has a rectangular central panel 42 and a series of flaps hingedly connected thereto. It is also preferably composed of water-resistant corrugated cardboard.

Side flaps 44 are connected along opposed side edges of panel 42; the joints between side flaps 44 and panel 42 are defined by crease lines 50.

Tabs 46 are hingedly connected to panel 42 in spaced relation from adjacent side flaps 44. Tabs 46 are also attached to panel 42 along crease lines 50.

Venting baffle 40 also includes a bottom flap 48 hingedly connecting panel 42 between opposed flaps 44. The joint between bottom flap 48 and panel 42 is defined by pre-scored crease line 52.

Side flaps 44 have additional perforated crease lines 53, 54 which extend parallel to crease line 50. Unlike crease lines 26, 27 of baffle 10, crease lines 53, 54 of venting baffle 40 do not extend along the full length of side flaps 44.

Perforated heel adjustment lines 56 extend between crease lines 50 and 54 at spaced intervals. A scale 58 is printed on one surface of baffle 40 adjacent crease lines 50, 53 and 54. The scale indicates the approximate distance between the bottom edge of panel 42 and the top edge of the truss heel when baffle 40 is installed.

Venting baffle 40 also has a series of framing adjustment lines comprising cut lines 66 and 68 and score lines 70 and 72 which are printed on one side of baffle 40 and extend lengthwise between the bottom edge of bottom flap 48 and the top edge of panel 42 parallel to crease lines 52. Framing adjustment lines 66–72 permit baffle 40 to be readily adapted for installation in houses having a non-standard rafter spacing.

For example, in most residential homes, the standard distance between the centre of adjacent rafters 30 is 24 inches. Accordingly, baffle 40 is 24 inches in overall width (measured from the outside edge of opposed side flaps 44). The overall width of baffle 40 can be reduced by cutting baffle 40 lengthwise along either cut lines 66 or 68. This permits baffle 40 to be installed in houses where the rafter spacing is 16 inches or 12 inches, for example.

To adapt baffle 40 for use in houses having 16 inch rafter spacing baffle 40 is first cut along cut line 68 and then folded along score line 72 to define a new side flap 44. New side flap 44 can then be cut to define a new tab 46 and to remove the bottom portion integral with bottom flap 48. The unused portions of baffle 40 are discarded.

To adapt baffle 40 for use in houses having 12 inch rafter spacing baffle 40 is cut along cut line 66 and folded along score lines 70. This results in two baffles of equal dimension each having one original side flap 44 and one newly defined side flap 44. The top and bottom portions of newly defined side flaps 44 are cut as discussed above to complete the conversion.

Baffle 40 also has supplementary heel adjustment lines 74 printed on one surface which extend between framing adjustment lines 66–72. Supplementary heel adjustment lines 74 are continuations of heel adjustment lines 56 printed on side flaps 44 at opposed ends of baffle 40. Accordingly, supplementary heel adjustment lines 74 correspond to different truss heel dimensions as labelled on scale 58. After converting baffle 40 for use in a house having either 12 or 16 inch rafter spacing, as the case may be, the installer can refer to scale 58 and then cut newly defined side flap 44 along the appropriate supplementary heel adjustment line 74 to match the truss heel size of the house in question.

As shown best in FIGS. 5 and 6, venting baffle 40 is installed between adjacent rafters 30 in a similar manner to baffle 10. Assuming rafters 30 are the standard 24 inches apart, the first installation step is to cut flaps 44 to conform to the truss heel dimensions of the house in question. The truss heel dimension is the vertical distance from the top plate 32 of the house to the roof deck 33.

Once the truss heel dimension is determined, the installer can refer to scale 58 to cut flaps 44 along the appropriate heel adjustment line 56. For example, if the heel size is 8 inches, flaps 44 are cut along the corresponding heel adjustment line 56 as indicated on scale 58.

Side flaps 44 are cut along the appropriate heel adjustment line 56 from crease line 50 to the outer edge of the adjacent side flap 44. This separates each side flap 44 into a first portion 62 and a second portion 64. First portion 62 is folded inwardly along crease line 50 to a position normal to panel 42. Second portion 64 is folded upwardly along crease line 50 to a position normal to panel 42. Tabs 46 and bottom flap 48 are similarly folded inwardly along crease lines 50 and 52 respectively in preparation for installation of baffle 40.

As best shown in FIG. 5, first portions 62 of side flaps 44 are fastened using tacks to the inner surface of ceiling joists 32 at their point of attachement to rafters 30. Second portions 64 of flaps 44 bear against the inner surface of rafters 30. Tabs 46 are securely fastened to rafters 30 to securely maintain baffle 40 in the desired position. Optionally, bottom flaps 48 may be fastened to top plate 32 in a similar manner.

If the rafter spacing in the house in question is 12 inches or 16 inches rather than the standard 24 inches, baffle 40 can be cut lengthwise along the appropriate cut lines 66, 68 prior to installation. Baffle 40 is then folded along the appropriate score lines 70, 72 as discussed above. Furthermore, the installer can compensate for small variations in framing dimensions by folding first portions 62 of flaps 44 along crease lines 53 or 54 rather than crease line 50.

It should be apparent from the foregoing that baffle 40 can be readily adapted to conform to different framing dimensions. By incorporating a series of strategically placed crease lines and printed markings rather than per-cut flaps, baffle 40 is more versatile and easier to handle and install than prior art devices.

Once baffle 40 is installed between adjacent rafters 30, it defines a passageway for the flow of ventilating air between soffit 35 and the attic cavity as shown in FIG. 6. In particular, the upper surface of panel 42 is installed in spaced relation from the underside of roof deck 33.

Like baffle 10, venting baffle 40 acts as a positive barrier preventing insulation from inadvertently falling through opening 36 into soffit 35 while preserving a dead air space above the attic insulation. Thus, venting baffle 40 is a combination air vent and air block: attic ventilation is accomplished without air flow through the attic insulation.

The optimal amount of attic ventilation depends on the surface area of the insulated ceiling of the house in question. In order to satisfy building code requirements in most jurisdictions it is usually not necessary to install venting baffles 40 between all of the house rafters. Rather, venting baffles 40 can be installed in combination with baffles 10 to provide the preferred amount of attic ventilation as discussed above.

In the usual situation a number of baffles 10 or venting baffles 40 will be stacked together in flat condition and packaged or sold in that form. Once delivered to the job site, baffles 10 and 40 can be installed as discussed above after roof deck 33 is fastened to rafters 30.

When used in combination baffles 10 and 40 provide a simple but effective and inexpensive way to prevent energy loss from an attic while assuring proper ventilation. As will be apparent to those skilled in the art in the light of the foregoing disclosure, many alternations and modifications are possible in the practice of this invention without departing from the spirit or scope thereof. Accordingly, the scope of the invention is to be construed in accordance with the substance defined by the following claims.

The embodiments of the invention in which an exclusive property or privilege is claimed are defined as follows:

1. A baffle for use in a house having an attic defined by:

(a) a vertical exterior wall having a horizontal top wall plate;

(b) parallel floor joists supported by said top wall plate; and (c) spaced apart, inclined roof rafters securely connected to said top wall plate and said floor joists, said roof rafters having a roof covering fastened on their upper surface;

said attic having a vent around its outer periphery between said top wall plate and the underside of said roof covering enabling the flow of ventilating air between an exterior soffit and insulating material installed between said floor joists in the interior of said attic, wherein said baffle is installable between adjacent roof rafters to block the flow of ventilating air through said insulating material, said baffle having:

(d) a rectangular panel;

(e) a bottom flap hingedly connected to said rectangular panel along a first fold line and attachable to said wall plate;

(f) first and second side flaps hingedly connected along second and third fold lines on opposed sides of said rectangular panel, said side flaps being attachable to the inner face of said roof rafters; and (g) a top flap hingedly connected along a fourth fold line to said rectangular panel and provided at either end thereof with a hingedly connected flap adapted to be secured to said inner face of said roof rafters;

wherein said first and second side flaps are provided with a plurality of printed lines perpendicular to said second and third fold lines and dividing said flaps into first and second sections of variable relative lengths, the length of said second section being chosen according to the distance between said wall plate and said underside of said roof, and scored lines provided on said second section parallel to said second and third fold lines for selectively varying the width of said second section and thereby adjust the width of said rectangular panel to different rafter spacings.

2. A baffle as defined in claim 1, further comprising adjustment lines parallel to said second and third fold lines printed on one surface of said rectangular panel for adapting said baffle for installation in houses having variable spacing between said adjacent roof rafters.

3. In combination, the baffle as defined in claim 1, and a second baffle installable between said adjacent roof rafters, wherein said second baffle comprises;

(h) a rectangular panel;

(i) a bottom flap hingedly connected to said rectangular panel and attachable to said wall plate;

(j) side flaps hingedly connected on opposed ends of said rectangular panel and attachable to the inner face of said roof rafters; and (k) a top flap hingedly connected to said rectangular panel and attachable to the underside of said roof covering.

4. A baffle as defined in claim 1, comprised of a unitary cardboard sheet having pre-scored crease lines defining the joins between said rectangular panel and said bottom flap, top flap and side flaps.

5. A baffle as defined in claim 4, wherein said crease line and said adjustment lines are perforated.

* * * * *